US008639147B2

(12) United States Patent
Qian et al.

(10) Patent No.: US 8,639,147 B2
(45) Date of Patent: Jan. 28, 2014

(54) METHOD AND SYSTEM FOR PRINTING ON PRE-PRINTED MEDIA AND LETTERHEAD MEDIA

(75) Inventors: Hui Qian, San Jose, CA (US); Kenneth Young, Foster City, CA (US)

(73) Assignee: Konica Minolta Laboratory U.S.A., Inc., San Mateo, CA (US)

( * ) Notice: Subject to any disclaimer, the term of this patent is extended or adjusted under 35 U.S.C. 154(b) by 280 days.

(21) Appl. No.: 13/074,122

(22) Filed: Mar. 29, 2011

(65) Prior Publication Data

US 2012/0251154 A1 Oct. 4, 2012

(51) Int. Cl.
*G03G 15/00* (2006.01)

(52) U.S. Cl.
USPC ..... 399/82

(58) Field of Classification Search
USPC ..... 399/6, 82, 371, 389
See application file for complete search history.

(56) References Cited

U.S. PATENT DOCUMENTS 7,120,382 B2 * 10/2006 Shimizu et al. ..... 399/392
2011/0051162 A1 * 3/2011 Okada ..... 358/1.12

* cited by examiner

*Primary Examiner* — Sandra Brase
(74) *Attorney, Agent, or Firm* — Buchanan Ingersoll & Rooney PC

(57) ABSTRACT

A method for managing the printing of documents on pre-printed media, which includes the steps of: receiving a print job representing a document to be printed; detecting an orientation of a pre-printed media being fed into an image forming apparatus; processing the print job for printing based on the orientation of the pre-printed media; and printing the print job on at least one sheet of the pre-printed media.

18 Claims, 5 Drawing Sheets

METHOD AND SYSTEM FOR PRINTING ON PRE-PRINTED MEDIA AND LETTERHEAD MEDIA

FIELD OF THE INVENTION

This invention relates to a system and method for managing the printing of documents on pre-printed media, such as letterhead media, and more particularly to a system and method of managing the printing of documents on pre-printed media by adjusting the data of the print job to correspond to the orientation of the pre-printed media.

BACKGROUND OF THE INVENTION

In today's modern office environment, it is imperative to have the capability of precisely positioning printed text and graphics on various types of pre-printed media and/or specialty paper. For example, letters to be mailed to customers should be printed on pre-prepared company letterhead, which is typically made of bond paper bearing a company logo inscribed thereon.

Office environments in large organizations typically have many types of printers connected in various ways; such as stand-alone printers connected to individual printers as well as network printers controlled by a printer server. Each of such printers has one or more paper trays (or input trays), such as large capacity paper trays, a manual feed tray, and universal trays, to accommodate various types of paper. In order to print characters and graphics at exact desired positions, it is often necessary to perform several trials-and-errors to produce desired results. This is often annoying, wasteful, and inconvenient especially when one is pressed with time-sensitive tasks In addition, printer engines can have different methods of loading pre-printed media. Some printer engines may require loading paper on the tray top-side with the letterhead away from the user, or top-side closer to the user, etc. It can be appreciated that even if the user loads the paper on the tray in the correct orientation, some sheets within the loaded stack of paper may be inverted (i.e., upside down).

With environmental consciousness growing, many organizations have adopted a "green culture" that encourages resource conservation while also promoting efficient resource utilization. In addition, when printing to the wrong or incorrect orientation (i.e., printing the print job up-side-down on the media or on the wrong side) on pre-printed media, letterhead media and/or specialty media wastes paper and/or media. Thus, there is a need for simple and efficient solutions that permit the seamless use of proper pre-printed media and/or letterhead media printing in modern printing environments.

Accordingly, it would be desirable to have a system and method, which when a networking printer detects an improper and/or wrong orientation of pre-printed media and/or letterhead media within an input tray, the network printer can correctly print the document so that the image or images correctly appear on the pre-printed media and/or letterhead media.

OBJECTS AND SUMMARY

The present invention has been made in consideration of the above issues, and provides a system and method of producing a print job using a pre-printed media and/or letterhead media by adjusting the orientation of the print image and/or pre-printed media within the feed mechanism of the image processing apparatus.

In accordance with an exemplary embodiment, a method for managing the printing of documents on pre-printed media, comprises: receiving a print job representing a document to be printed; detecting an orientation of pre-printed media being fed into an image forming apparatus; processing the print job for printing based on the orientation of the pre-printed media; and printing the print job on at least one sheet of the pre-printed media.

In accordance with another exemplary embodiment, a computer program product comprising a non-transitory computer usable medium having a computer readable code embodied therein, the computer readable program code configured to cause the image forming apparatus to execute a process for managing the printing of documents on pre-printed media, the process comprising the steps of: receiving a print job representing a document to be printed; detecting an orientation of pre-printed media being fed into the image forming apparatus; processing the print job for printing based on the orientation of the pre-printed media; and printing the print job on at least one sheet of the pre-printed media.

In accordance with a further exemplary embodiment, an image forming apparatus comprises: an input tray having at least one sheet of a pre-printed media therein; an image sensor for detecting an orientation of the at least one sheet of pre-printed media being fed into the image forming apparatus from the input tray; a memory unit, the memory unit having a firmware application which processes a print job for printing based on the orientation of the pre-printed media; and a print engine connected to the memory unit for printing the print job on at least one sheet of the pre-printed media.

It is to be understood that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
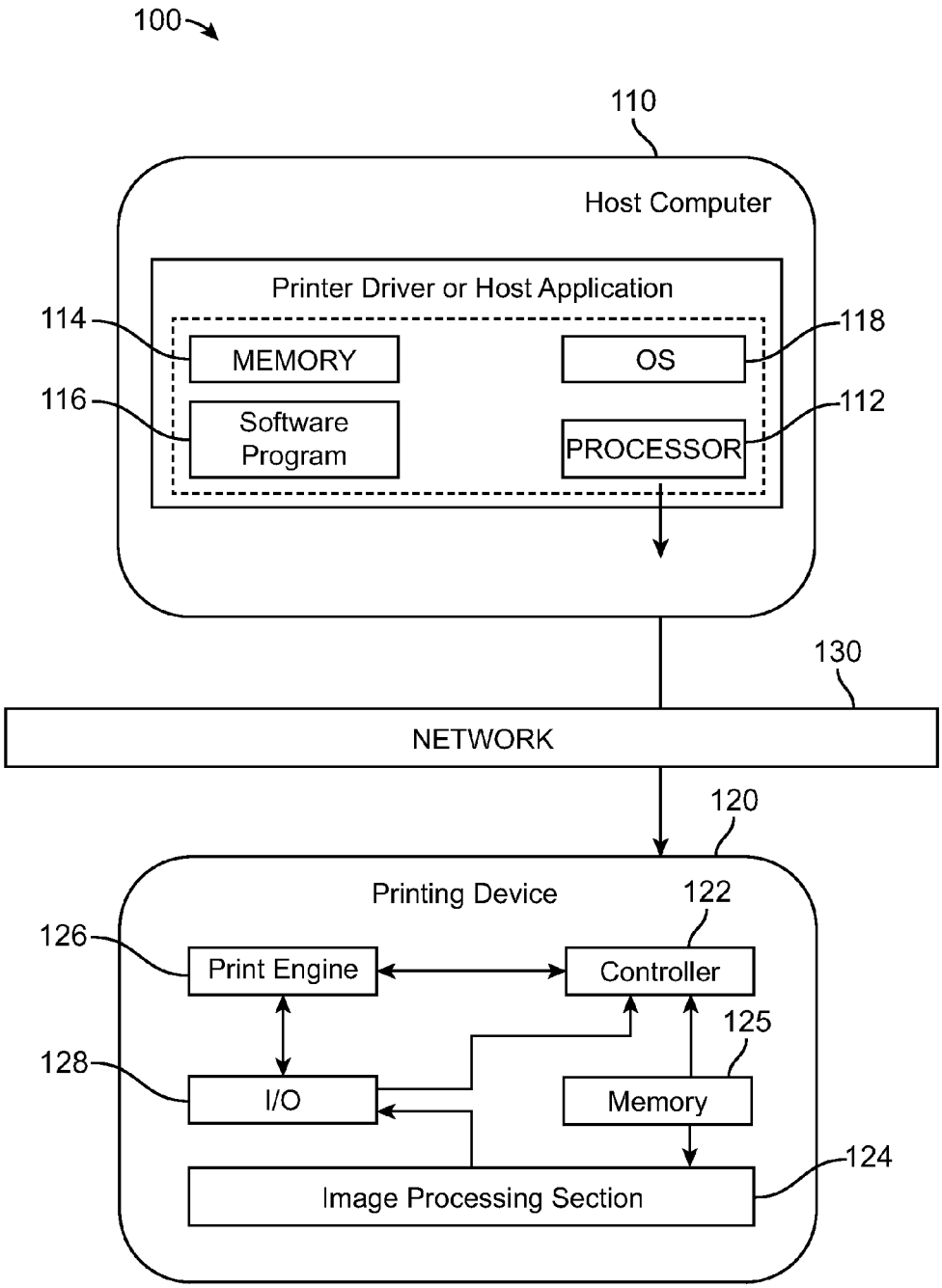
FIG. 1 is a diagram of a system, which includes a host device, which sends print data and an image forming apparatus connected to the host computer, which receives print data in accordance with an exemplary embodiment.

Reference will now be made in detail to the present preferred embodiments of the invention, examples of which are illustrated in the accompanying drawings. Wherever possible, the same reference numbers are used in the drawings and the description to refer to the same or like parts.

In accordance with an exemplary embodiment, a system and method for producing a print job using a pre-printed media and/or letterhead media. The following illustrations describe the process of this method and a system for implementation thereof.

It would be desirable to have a method and system, which detects an orientation of pre-printed media and/or letterhead media, and if necessary adjusts and/or modifies the printer so that the print job (or print data) is properly printed on the document and/or medium. It can be appreciated that when printing on pre-printed media and/or letterhead media having pre-printed images and/or logos, that one of four (4) cases can occur: same side, zero degree rotation (i.e., paper is correctly positioned), same side, 180 degree rotation (i.e., paper is rotated 180 degrees), inverted front to back side, zero degree rotation (i.e., paper is upside down), or inverted front to back side, 180 degree rotation (i.e., paper is upside down and rotated 180 degrees).

In accordance with an exemplary embodiment, a method executed by an image forming apparatus for producing a print job, includes the steps of: receiving a print job representing a document to be printed; detecting an orientation of the pre-printed media being fed into the image forming apparatus; processing the print job for printing based on the orientation of the pre-printed media; and printing the print job on at least one sheet of the pre-printed media.

FIG. 1 is an illustration of a data processing system 100, which includes a computer device 110 (or host device) and an image forming apparatus 120 (or printer) connected to the computer device 110. The computer device 110 preferably includes a processor or central processing unit (CPU) 112, one or more memories 114 for storing software programs 116 and data (such as files to be printed). The computer device 110 also includes an operating system (OS) 118, which manages the computer hardware and provides common services for efficient execution of various software programs 116. The processor or CPU 112 carries out the instructions of a computer program, which operates and/or controls at least a portion of the functionality of the computer device 110. It can be appreciated that examples of computer devices 100 include and are not limited to personal computers, image forming apparatuses, routers, and/or personal digital assistants (PDAs).

In accordance with an exemplary embodiment, the image forming apparatus 120 is preferably in the form of a multi-functional printer (MFP) connected to the computer device 110. The computer device 110 submits print jobs to the image forming apparatus (printer or printing device) 120 by transmitting data representing the documents to be printed and information describing the print job. The image forming apparatus (i.e., printer/printing device) 120 typically includes a controller 122, an image processing section (or data dispatcher) 124, a memory section 125 preferably in the form of a hard disk drive (HDD), a print engine 126, and an input/output (I/O) section 128.

The controller 122 includes a central processing unit (CPU), a random access memory (RAM), and a read only memory (ROM). The central processing unit is configured to execute a sequence of stored instructions (i.e., a computer program). It can be appreciated that the controller 122 includes an operating system, which acts as an intermediary between the software programs and hardware components within the image forming apparatus 120. The operating system (or OS) manages the computer hardware and provides common services for efficient execution of various software applications. In accordance with an exemplary embodiment, the controller 122 processes the data and job information received from the computer device 110 to generate a print image.

The image processing section 124 carries out image processing under the control of the controller 122, and sends the processed print image data to the print engine 126. The print engine 126 forms an image on a recording sheet based on the image data sent from the image processing section 124. The I/O 128 section performs data transfer with the host computer 110. The controller 122 is programmed to process data and control various other components of the image forming apparatus or printer 120 to carry out the various methods described herein. The hard disk drive (HDD) or storage device stores digital data and/or software programs for recall by the controller 122. In accordance with an exemplary embodiment, the digital data includes resources, which can include graphics/images, logos, form overlays, fonts, etc.

The input/output (I/O) port 128 provides communications between the printer section and the computer device 110 and receives page descriptions (or print data) from the host for processing within the image forming apparatus 120. In accordance with an exemplary embodiment, the operation of printer section commences when it receives a page description from the computer device 110 via I/O port 128 in the form of a print job data stream. The page description may be any kind of page description languages (PDLs), such as PostScript® (PS), Printer Control Language (PCL), Portable Document Format (PDF), XML Paper Specification (XPS), and so on. The computer device 110 and the image forming apparatus (or printer) 120 are preferably connected to one another via a network 130. Examples of the network 130 consistent with embodiments of the invention include, but are not limited to, the Internet, an intranet, a local area network (LAN) and a wide area network (WAN). The image forming apparatus 120 and the computer device 110 can be connected with a wire or be connected with wireless by using radio frequency (RF) and/or infrared (IR) transmission.

Examples of image forming apparatuses 120 consistent with exemplary embodiments of the invention include multi-function printers or peripheral (MFP), a laser beam printer (LBP), an LED printer, a multi-functional laser beam printer including copy function. In accordance with another exemplary embodiment, the image forming apparatus 120 is configured as a multi-function printer or peripheral (MFP) device or all-in-one (AIO) that includes a printer section for converting print data inputted from outside to image data and forming and printing out the converted image onto a printable media, a scanner section for optically reading a document, and a facsimile section for facsimile receiving and transmitting image data to and from external apparatuses through public lines.

Figure 2:
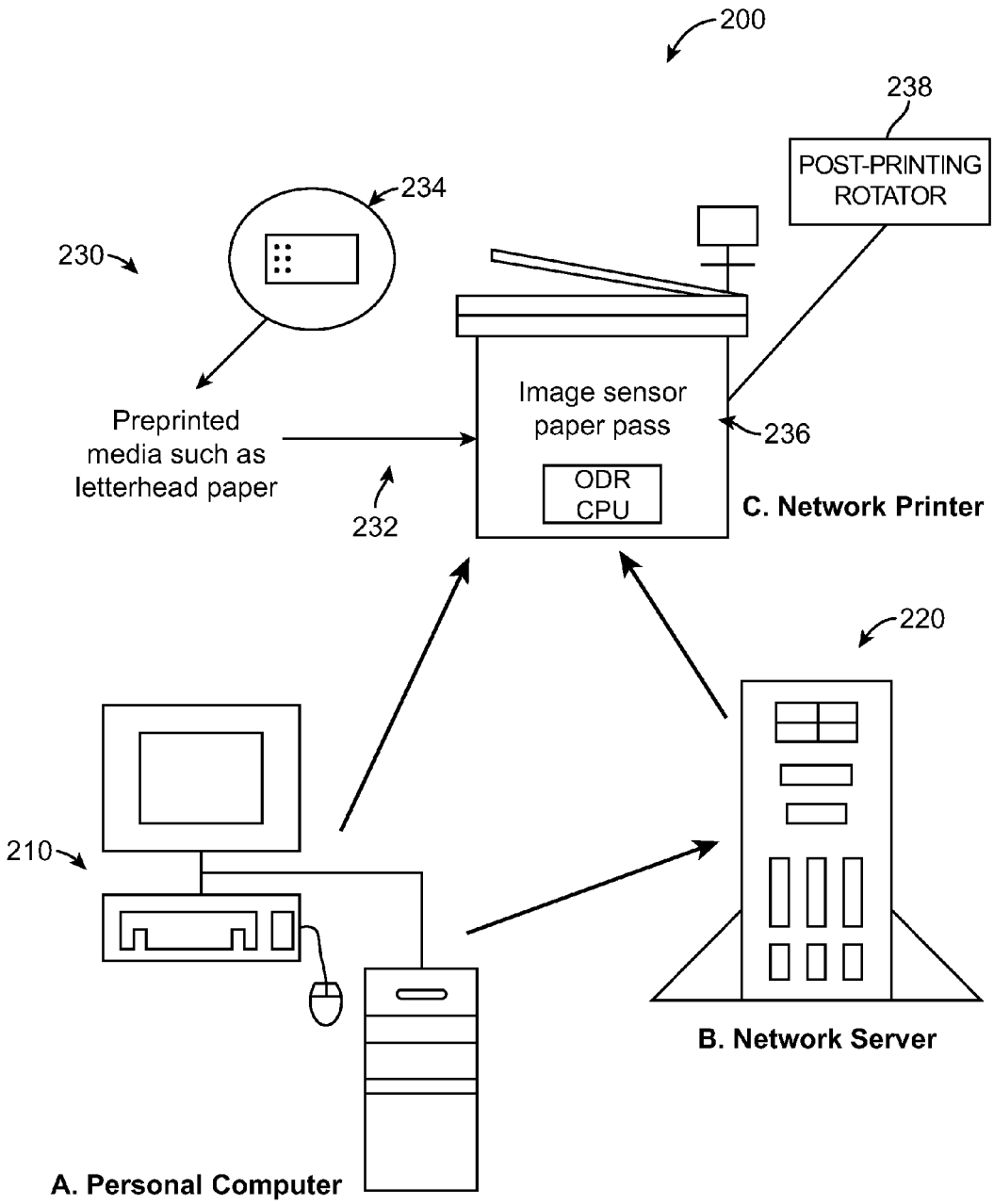
FIG. 2 is a block diagram of a system for managing the printing of documents on pre-printed media and/or letterhead media in accordance with an exemplary embodiment.

FIG. 2 is a block diagram of another system 200 for managing the printing of documents on pre-printed media and/or letterhead media in accordance with an exemplary embodiment. As shown in FIG. 2, the system 200 includes a host computer or device 210, which transmits print data in the form of a print job to a network server 220 and/or directly to a network printer 230. The network printer 230 includes an input tray 232 having a pre-printed media (i.e., letterhead media) 234, which includes images, logos and the like, which have been pre-printed onto each of the sheets of media within the input tray 232. The image forming apparatus 230 includes an image sensor 236, which can be a separate sensor within the image forming apparatus or network printer 230, or alternatively, the image sensor 236 can be part of the image processing portion of the image forming apparatus or network printer 230. In accordance with an exemplary embodiment, the image sensor 236 preferably includes an optical direction recognition system, which can detect an orientation of the logos and/or other indicia on a pre-printed media by recognition of a portion of the pre-printed sheet. The pre-printed media 234 is obtained from the input tray 232 and is scanned by the image sensor 236, which is coupled to the input tray 232. The system 200 can also include a mechanical rotator or post-printing rotator 238, which mechanically rotates a sheet of pre-printed media after printing and prior to stacking and/or finishing.

Figure 3:
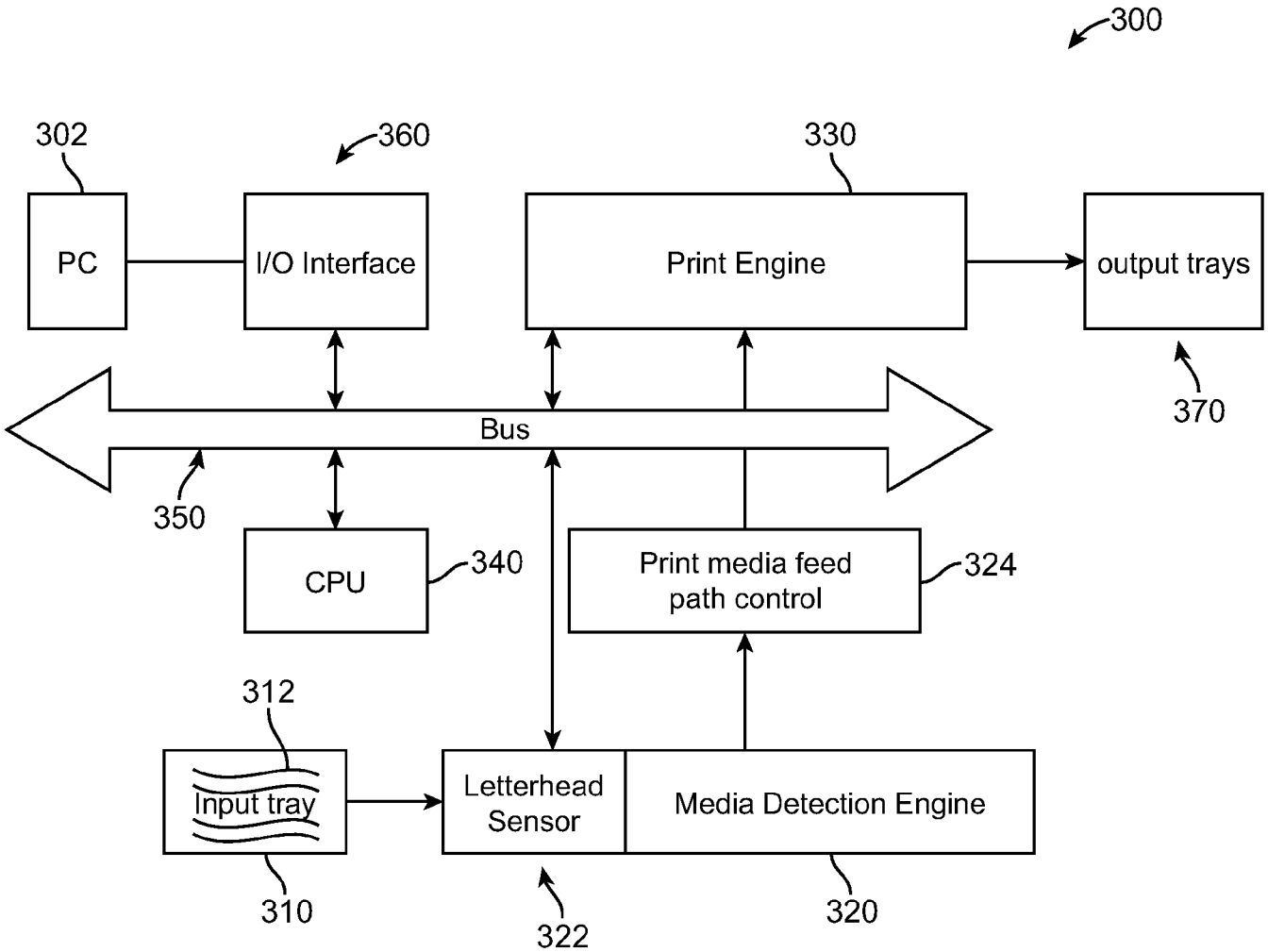
FIG. 3 is a block diagram illustrating components of an exemplary printer for managing the printing of documents in systems using pre-printed media and/or letterhead media in accordance with another exemplary embodiment.

FIG. 3 is a block diagram illustrating components of an exemplary image forming apparatus or printer 300 for managing the printing of documents in systems using pre-printed media and/or letterhead media in accordance with another exemplary embodiment. As shown in FIG. 3, the image forming apparatus 300 for printing documents comprises at least one input tray 310 capable of holding pre-printed media 312, and a pre-printed media and/or letterhead media detection engine 320 having at least one image sensor 322. The at least one image sensor 322 is capable of detecting a pre-printed media and/or a letterhead print media's position and/or orientation as the pre-printed media is fed into the network printer 300. In accordance with an exemplary embodiment, the image sensor 322 can be a line scan sensor, an optical direction recognition program (ODR) and/or other suitable detection system.

A print engine 330 places marks on documents and is capable of duplex printing. In accordance with an exemplary embodiment, the image sensor 322 (i.e., pre-printed media or letterhead media detection engine) includes an ODR program (optical direction recognition program), which generates a signal, which is processed by a central processing unit (or CPU) 340. Once the pre-printed media (or paper) 312 is scanned by the image sensor 322, which is preferably placed on paper pass, the optical detection recognition program (ODR) sends a signal to the CPU 340 with instructions to have the receiving data (or print job) printed to proper position and/or orientation with respect to the corresponding orientation of the logos and/or indicia on the pre-printed media 312. For example, the image data (or print job) can be rotated 180 degrees for a sheet or a plurality of sheets of pre-printed media, which have incorrectly been placed within the input tray. Alternatively, if the pre-printed media is 180 degrees from required (i.e., turned around within the input tray), by rotating the print image within the print job, the document prints with a proper orientation with regard to the pre-printed media and/or letterhead media, and thus yielding a proper and expected output.

It can be appreciated that in accordance with an exemplary embodiment, that an image sensor 322 having an optical detection recognition program (ODR) does not require detection of the entirety (or whole) of the pre-printed media or document, and only needs to detect the direction of pre-printed media including logos and other indicia. For example, on standard letterhead media, which includes a phone number or company address (i.e., numerals), the optical detection recognition program (ODR) is able to detect the numeral and/or numbers within the logo and/or other indicia to determine the proper orientation of the pre-printed media. In accordance with an exemplary embodiment, the image sensor having an optical detection recognition program can detect the proper direction based solely on numeric and/or numeral characters.

It can be appreciated that since the rotation of the image or print data occurs in real time, in some instances, it would be very difficult for the firmware and/or hardware associated with the image forming apparatus to have enough time to rotate the image or print data 180 degrees, each and every time a sheet of pre-printed media is incorrectly placed within the input tray. Especially for high speed image forming apparatuses and/or printers 300, which can print in excess of 80 sheets per minute. In accordance with an exemplary embodiment, the printer driver within the host computer 302, or alternatively, the firmware within the image forming apparatus 300 preferably generates at least four (4) print images, which are stored with the image forming apparatus and provided to the print engine as necessary. In accordance with an exemplary embodiment, the at least four print images include two portrait print images, which are 180 degrees to one another (i.e., each image faces away from the other), and two landscape print images, which are 180 degrees to each other as well. It can be appreciated that by generating the at least four print images (i.e., two (2) portrait print images and two (2) landscapes print images), which are 180 degrees to one another, the printer engine 330 needs to only select the proper print image from the printer driver and/or firmware, rather than processing the print job each and every time that an image or print job needs to be rotated for a pre-printed media, which is not properly oriented and/or correctly positioned within the input tray and/or feeding mechanism.

In accordance with another exemplary embodiment, the image sensor 322 can use optical character recognition, or OCR, which is the mechanical or electronic translation of scanned images of handwritten, typewritten or printed text into machine-encoded text to determine the orientation of the pre-printed media. It can be appreciated that OCR is widely used to convert books and documents into electronic files, to computerize a record-keeping system in an office, or to publish the text on a website.

In accordance with another exemplary embodiment, the letterhead media detection engine 320 can provide the user with an option of enabling and/or disabling sample printing of the print job on the pre-printed media. For example, a user could define this option from either the printer driver within the host computer 302, or alternatively, the network printer's display (not shown). In accordance with an exemplary embodiment, when sample printing is enable or on, the user can configure the option as desired, for example, only prints the first page, and/or prints a certain number of pages to a specific output tray. In addition, the user can check whether the printed image is as desired, and, if not, the user is able to cancel the print job in its entirety.

As shown in FIG. 3, the image forming apparatus or printer 300 also preferably includes a bus 350 that couples the central processing unit ("CPU") 340, an input-output ("I/O") interface 360, the print engine 330, and at least one output tray 370. The bus 350 is a subsystem, which transfers data between components within the image forming apparatus 300. Once the pre-printed media 312 has been imaged or scanned by the image sensor 322, the orientation of the pre-printed media is send via a print media feed path control 324 to the print engine 330. The image forming apparatus or printer 300 also contains other devices such as firmware, ROM, memory (RAM), secondary storage, Application Specific Integrated Circuits ("ASICs"), and/or Field Programmable Gate Arrays ("FPGAs") that are capable of executing portions of an application to manage the printing of documents according to disclosed embodiments.

In accordance with an exemplary embodiment, the central processing unit (CPU) 340 can be a general-purpose processor, a special purpose processor, a micro control unit ("MCU"), and/or an embedded processor. It can be appreciated that that the central processing unit (CPU) 340 exchanges data including control information and instructions with the I/O interface 360, the print engine 330, and the pre-printed media (or letterhead media) detection engine 320. The CPU 340 also executes instructions and routines stored in firmware including but not limited to a boot-up sequence, pre-defined routines, memory management routines, and other code. In some embodiments, the CPU may act upon instructions and data and provide control and data to the print engine 330 to generate printed documents.

In accordance with an exemplary embodiment, the pre-printed media 312 obtained from the input tray 310 can be scanned by an image sensor 322, which is preferably coupled to the input trays paper feed path. In accordance with an exemplary embodiment, the image sensor 322 is part of a pre-printed media or letterhead media detection engine 320, which uses input provided by the at least one image sensor 322 to determine if the pre-printed media that is being currently processed includes a proper pre-printed or letterhead orientation or not, and wherein appropriate action based on the print job settings and media type can be performed. It can be appreciated that the general pre-printed media or letterhead media detection engine 320 can be implemented by hardware, software, firmware, or some combination thereof.

In accordance with an exemplary embodiment, in a case where there are only a few sheets of paper (or pre-printed media) being incorrectly loaded in a rotated orientation while the remaining sheets of paper being correctly loaded, then the printer engine is still able to print the page; however, during the finishing process, the mechanical rotator or post-printing rotator 238 physically rotates the pre-printed media as it leaves the image forming apparatus or printer 230, and prior to stacking or finishing of the printed pre-printed media.

Figure 4:
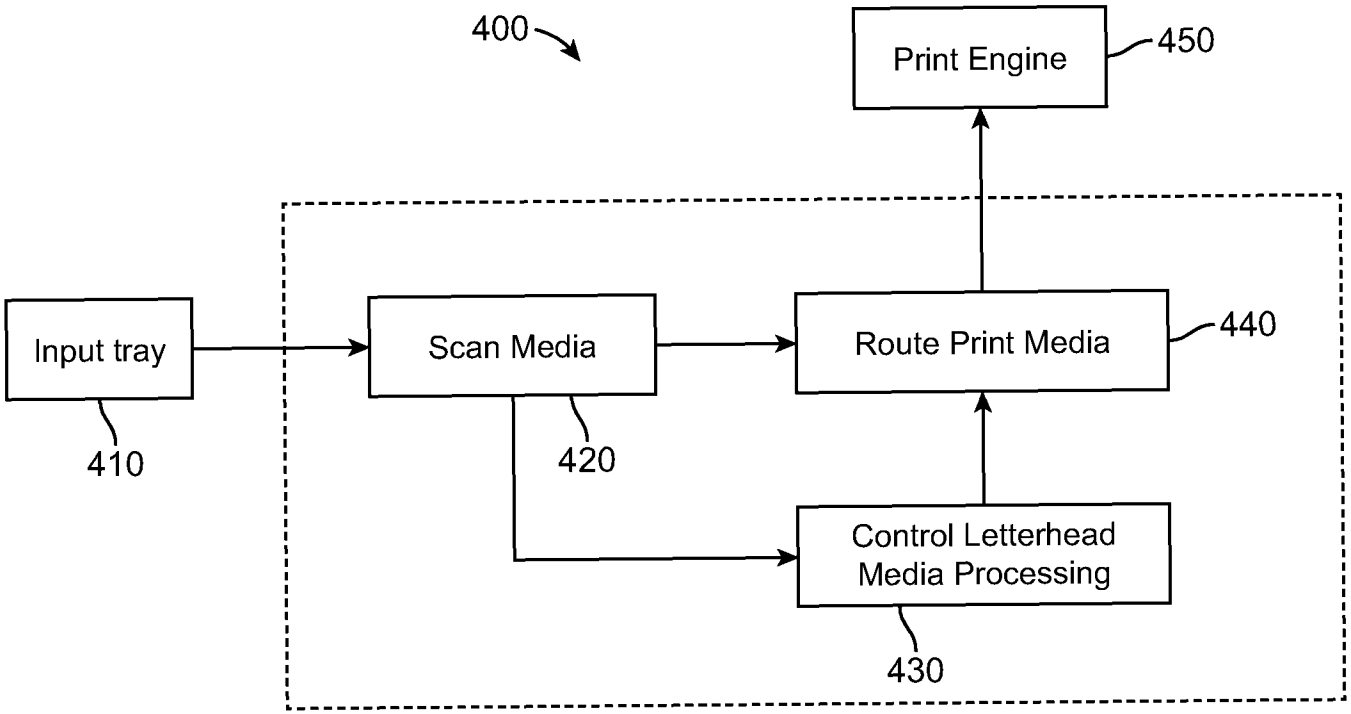
FIG. 4 is a diagram of an exemplary process flow illustrating the interaction of functional blocks with components used for managing the printing of documents in systems using pre-printed media and/or letterhead media in accordance with a further exemplary embodiment.

FIG. 4 is a diagram of an exemplary process flow illustrating the interaction of functional blocks with components used for managing the printing of documents in a system 400 using letterhead media in accordance with a further exemplary embodiment. The system 400 includes an input tray 410 having one or more sheets of a pre-printed media, an image sensor 420, a control letterhead media processing section 430, a system 440 for routing the pre-printed media to the print engine 450. As shown in FIG. 4, the input tray 410 includes one or more sheets of pre-printed media, which is fed through the image sensor 420. The image sensor 420 preferably in the form of an optical character recognition, or OCR detection system determines an orientation of the pre-printed media passing through the image sensor 420, which is transmitted to the control letterhead media processing section 430 for processing. The image sensor 420 scans each sheet of the pre-printed media, which is then sent to system 440 for routing of the pre-printed media to the print engine 450 of the image forming apparatus 400.

Figure 5:
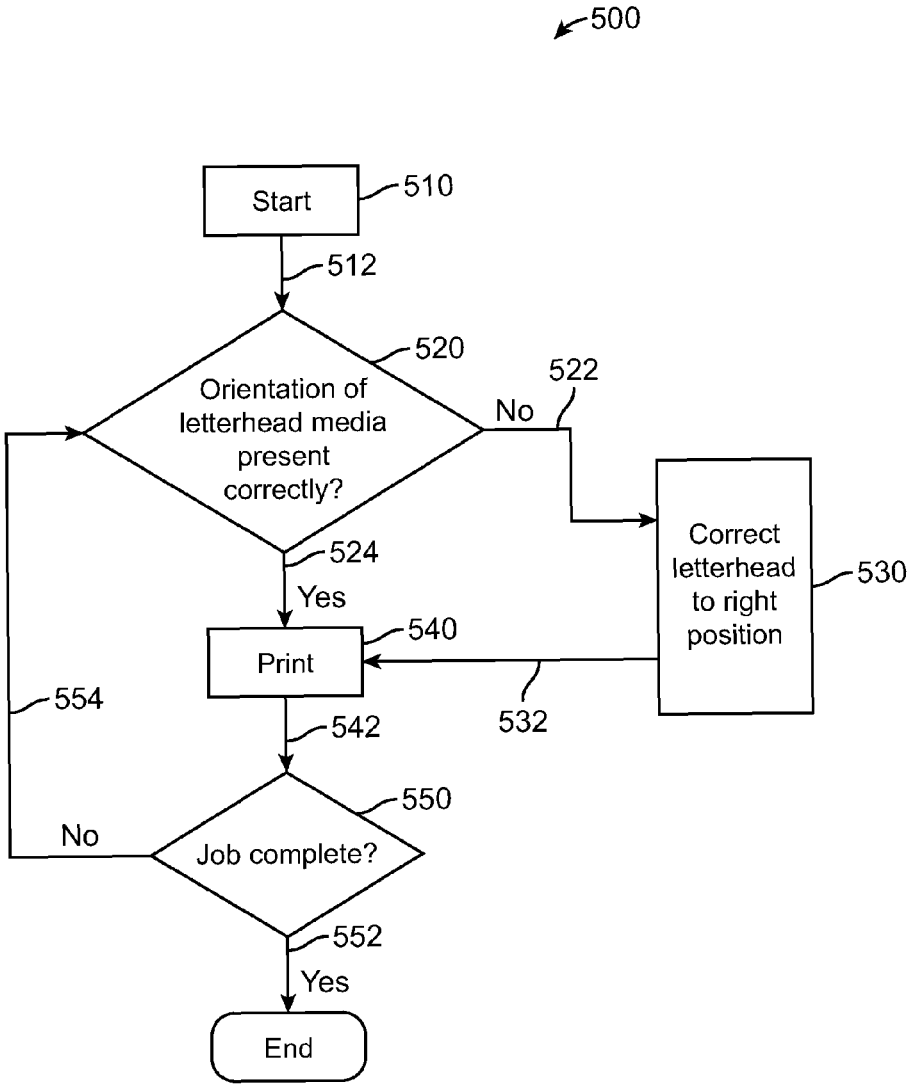
FIG. 5 is a flowchart depicting an exemplary method for managing the printing of print jobs in systems using pre-printed media and/or letterhead media in an exemplary embodiment.

FIG. 5 is a flowchart depicting an exemplary method for managing the printing of print jobs in systems using letterhead media 500 in an exemplary embodiment. As shown in FIG. 5, in step 500, print data in the form of a print job is sent 512 to an image forming apparatus, which includes an input tray holding a pre-printed media having a logo, indicia and/or a letterhead thereon. It can be appreciated that the print data (or print job) can include data received from an external device such as a host computer, or alternatively, from data generated by image forming apparatus, such as scanning an original hard copy on the image forming apparatus or the like. In step 520, the orientation of the pre-printed media is determined using an image sensor. If the pre-printed media is correctly oriented, the pre-printed media is sent 524 to the print engine for printing. Alternatively, if the orientation of the pre-printed media is incorrect 522, in step 530, the orientation of the pre-printed media is corrected by either adjusting (i.e., rotating the print image) the print data or image generated therefrom, physically rotating the pre-printed media to the correct orientation, or alternatively, canceling the print job and/or sending a signal or message to the user that the pre-printed media is incorrectly positioned within the input tray and needs to be physically rotated before processing by the image forming apparatus. Once the pre-printed media has been correctly oriented for printing, the pre-printed media is sent 532 for printing 540. The print job is then printed 542 on the pre-printed media. In step 550, if the print job is completed, a signal 552 is sent indicating to the print engine and image forming apparatus that the print job has been completed. Alternatively, if the print job has not been completed in its entirety, a signal 554 is sent to the image sensor to sense the next sheet of pre-printed media being fed from the input tray. The process continues sheet-by-sheet basis until the print job has been printed in its entirety.

In accordance with another exemplary embodiment, a computer program product comprising a non-transitory computer usable medium having a computer readable code embodied therein, the computer readable program code configured to cause the image forming apparatus to execute a process for managing the printing of documents on pre-printed media. The process comprises the steps of: receiving a print job representing a document to be printed; detecting an orientation of a pre-printed media being fed into the image forming apparatus; processing the print job for printing based on the orientation of the pre-printed media; and printing the print job on at least one sheet of the pre-printed media.

It can be appreciated that the process and method can be introduced into the apparatus by updating the printer driver (or host application) 118 in the host device 110 and/or the firmware in the non-volatile memory of the image forming apparatus 120. In this regard, the method may be brought to the apparatus in a form of a package of install software and the printer driver and firmware, which may be divided and/or compressed so that the install software effectively installs the printer driver and firmware. The package may be steadily stored in a computer readable diskette, such as a compact disk, or may be transmitted through a wire/wireless communication line.

The method described above can be used to print on paper or other suitable printing medium such as thin plastic sheets, etc. The non-transitory computer readable medium, of course, can be a magnetic recording medium, a magneto-optic recording medium, or any other recording medium which will be developed in future, all of which can be considered applicable to the present invention in all the same way. Duplicates of such medium including primary and secondary duplicate products and others are considered equivalent to the above medium without doubt. Furthermore, even if an embodiment of the present invention is a combination of software and hardware, it does not deviate from the concept of the invention at all. The present invention can be implemented such that its software part has been written onto a recording medium in advance and will be read as required in operation.

Thus, as used in this disclosure and the appended claims, the term "image forming apparatus", "printer" or "printing device" should be broadly understood to refer to any machine that has a print function, including printers, copiers, and all-in-one machines which have printing, scanning and copying functions. The term "print job" and/or "printing" similarly include both printing and copying, i.e., it refers to producing images on a recording medium either from a data received from an external device such as a host computer or from data generated by scanning an original hard copy.

It will be apparent to those skilled in the art that various modifications and variation can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for managing the printing of documents on pre-printed media, comprising:

receiving a print job representing a document to be printed;

detecting an orientation of pre-printed media being fed into an image forming apparatus, wherein detecting the orientation of the pre-printed media comprises scanning the pre-printed media using an image sensor to detect the orientation of each sheet of pre-printed media being fed into the image forming apparatus;

processing the print job for printing based on the orientation of the pre-printed media; and printing the print job on at least one sheet of the pre-printed media.

2. The method of claim 1, wherein the image sensor includes an optical direction recognition program (ODR program).

3. The method of claim 1, wherein the step of processing the print job for printing comprises sending the orientation of the pre-printed media to a print engine for printing of the print job on the at least one sheet of pre-printed media.

4. The method of claim 1, wherein the step of processing the print job further comprises rotating an orientation of images within the print job by 180 degrees upon detection that the orientation of the pre-printed media is 180 degrees from desired.

5. The method of claim 1, further comprising generating at least four print images for each print job, and wherein the at least four images include at least two portrait print images, which are 180 degrees to each other, and at least two landscape print images, which are 180 degrees to each other, and upon detecting the orientation of the pre-printed media, selecting one of the at least four images for the printing of the print job.

6. The method of claim 1, further comprising processing the orientation of the pre-printed media as detected by the image sensor with a central processing unit (CPU) within the image forming apparatus, and wherein the central processing unit provides instructions to a print engine for printing of the print job.

7. The method of claim 1, further comprising detecting only a portion of the pre-printed media with the image sensor.

8. The method of claim 1, further comprising mechanically rotating after printing each sheet of pre-printed media having an orientation, which is 180 degrees to a printed stack of pre-printed media.

9. The method of claim 1, further comprising canceling the print job upon detecting that the pre-printed media has been placed in the input tray upside down.

10. The method of claim 1, wherein the pre-printed media is fed into the image forming apparatus from an input tray.

11. A computer program product comprising a non-transitory computer usable medium having a computer readable code embodied therein, the computer readable program code configured to cause the image forming apparatus to execute a process for managing the printing of documents on pre-printed media, the process comprising the steps of:

receiving a print job representing a document to be printed;

detecting an orientation of a pre-printed media being fed into the image forming apparatus, wherein detecting the orientation of the pre-printed media comprises scanning the pre-printed media using an image sensor to detect the orientation of each sheet of pre-printed media being fed into the image forming apparatus;

processing the print job for printing based on the orientation of the pre-printed media; and printing the print job on at least one sheet of the pre-printed media.

12. The computer program of claim 11, wherein the step of processing the print job further comprises rotating an orientation of images within the print job by 180 degrees upon detection that the orientation of the pre-printed media is 180 degrees from desired.

13. The computer program of claim 11, further comprising generating at least four print images for each print job, and wherein the at least four images includes at least two portrait print images, which are 180 degrees to each other, and at least two landscape print images, which are 180 degrees to each other, and upon detecting the orientation of the pre-printed media, selecting one of the at least four images for the printing of the print job.

14. An image forming apparatus comprising:

an input tray having at least one sheet of a pre-printed media therein;

an image sensor for detecting an orientation of the at least one sheet of pre-printed media being fed into the image forming apparatus from the input tray;

a memory unit, the memory unit having a firmware application which processes a print job for printing based on the orientation of the pre-printed media; and a print engine connected to the memory unit for printing the print job on at least one sheet of the pre-printed media.

15. The image forming apparatus of claim 14, wherein the image sensor scans the pre-printed media using an optical direction recognition program to detect the orientation of each sheet of pre-printed media being fed into the image forming apparatus.

16. The image forming apparatus of claim 15, further comprising generating at least four print images for each print job, and wherein the at least four images include at least two portrait print images, which are 180 degrees to each other, and at least two landscape print images, which are 180 degrees to each other, and upon detecting the orientation of the pre-printed media, selecting one of the at least four images for the printing of the print job.

17. The image forming apparatus of claim 16, further comprising a post-printing rotator, which mechanically rotates after printing each sheet of pre-printed media having an orientation, which is 180 degrees to a printed stack of pre-printed media.

18. The image forming apparatus of claim 17, further comprising canceling the print job upon detecting that the pre-printed media has been placed in the input tray upside down.

* * * * *